US010224608B2

(12) United States Patent
Lee et al.

(10) Patent No.: US 10,224,608 B2
(45) Date of Patent: Mar. 5, 2019

(54) ANTENNA DEVICE AND ELECTRONIC DEVICE INCLUDING THE SAME

(71) Applicant: Samsung Electronics Co., Ltd., Suwon-si, Gyeonggi-do (KR)

(72) Inventors: Kyung-Jae Lee, Seoul (KR); Kyung-Jong Lee, Hwaseong-si (KR); Sewoong Kim, Gimhae-si (KR); Soo-Young Jang, Daegu (KR); Seunghwan Kim, Seoul (KR); Hosaeng Kim, Anyang-si (KR); Jinwoo Jung, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 82 days.

(21) Appl. No.: 15/217,516

(22) Filed: Jul. 22, 2016

(65) Prior Publication Data

US 2017/0047639 A1 Feb. 16, 2017

(30) Foreign Application Priority Data

Aug. 10, 2015 (KR) ..... 10-2015-0112620

(51) Int. Cl.
*H01Q 1/24* (2006.01)
*H01Q 1/48* (2006.01)
(Continued)

(52) U.S. Cl.
CPC ..... *H01Q 1/243* (2013.01); *H01Q 1/48* (2013.01); *H01Q 7/00* (2013.01); *H01Q 9/42* (2013.01)

(58) Field of Classification Search
CPC ..... H01Q 1/243; H01Q 1/48; H01Q 21/28; H01Q 7/00
(Continued)

(56) References Cited

U.S. PATENT DOCUMENTS

2011/0032165 A1* 2/2011 Heng ..... H01Q 7/005 343/745
2012/0235866 A1 9/2012 Kim et al.
(Continued)

FOREIGN PATENT DOCUMENTS

KR 10-2012-0105867 A 9/2012
KR 10-2012-0117048 A 10/2012
KR 10-2014-0020670 A 2/2014

*Primary Examiner* — Hai Tran
(74) *Attorney, Agent, or Firm* — Jefferson IP Law, LLP

(57) ABSTRACT

An electronic device is provided. The electronic device includes a housing including a first face, a second face, and a side face that at least partially encloses a space between the first face and the second face, a conductive member configured to form at least a portion of the side face, a ground member, at least one communication circuit, and a conductive pattern positioned within the housing, the conductive pattern electrically connected to the communication circuit and the ground member, a first electric path positioned within the housing, and configured to electrically interconnect another end of the conductive member and the communication circuit, a second electric path configured to electrically interconnect the first electric path or the conductive member and the ground member, and a third electric path configured to electrically interconnect the first electric path or the conductive member and the ground member, and including a switching circuit.

14 Claims, 12 Drawing Sheets

(51) Int. Cl.
*H01Q 7/00* (2006.01)
*H01Q 9/42* (2006.01)

(58) Field of Classification Search
USPC ..... 343/702
See application file for complete search history.

(56) References Cited

U.S. PATENT DOCUMENTS

2014/0266922 A1* 9/2014 Jin ..... H01Q 21/28
343/702
2014/0266923 A1* 9/2014 Zhou ..... H01Q 5/35
343/702
2015/0255857 A1 9/2015 Kim et al.

* cited by examiner

ANTENNA DEVICE AND ELECTRONIC DEVICE INCLUDING THE SAME

CROSS-REFERENCE TO RELATED APPLICATION(S)

This application claims the benefit under 35 U.S.C. § 119(a) of a Korean patent application filed on Aug. 10, 2015 in the Korean Intellectual Property Office and assigned Serial number 10-2015-0112620, the entire disclosure of which is hereby incorporated by reference.

TECHNICAL FIELD

The present disclosure relates to an electronic device. More particularly, the present disclosure relates to an electronic device that includes an antenna device.

BACKGROUND

As functional differences have been considerably reduced among electronic devices, each manufacturer makes efforts to increase the rigidity of electronic devices, to strengthen the design aspect of the electronic devices, and to slim the electronic devices. As one aspect of such a trend, efforts are made to efficiently secure a space for disposing at least one antenna device that shall be essentially provided for communication among the components of the electronic devices, and at the same time, to prevent the degradation of the radiating performance of the antenna device in advance and to make the antenna device exhibit excellent performance.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an antenna devices used in an electronic device have an inverted-F antenna (IFA) or a monopole radiator as a basic structure, and the volume and number of the mounted antenna radiators may be determined based on the frequency, the bandwidth, and the kind of each service. For example, although there is a difference in frequency from region to region in the world, typically a low band of 700 MHz to 900 MHz, a mid band of 1,700 MHz to 2,100 MHz, and a high band of 2,300 MHz to 2,700 MHz are used as main communication bands. In addition, various wireless communication services, such as Bluetooth (BT), global positioning system (GPS), and Wi-Fi, are used. However, in order to satisfy all the above-described communication bands in a limited antenna volume of a given communication device, it is practically difficult to secure the entire band only with one antenna. In order to overcome this problem, service bands, which are similar to each other in terms of frequency bands, are lumped with each other and are designed to be split to several antennas.

For example, an antenna that is in charge of voice/data communication (e.g., general packet radio service (GPRS), wideband code division multiple access (WCDMA), or long term evolution (LTE)), which is a major communication of a terminal, may be positioned in a lower portion of an electronic device where few metallic components, which inhibit antenna performance, exist. By European standards, 24 bands in total should be implemented including 2G (global system for mobile communications (GSM850), extended global system for mobile communications (EGSM), distributed control system (DCS), personal communications service (PCS)), WCDMA (B1, B2, B5, B8), and LTE (B1, B2, B3, B4, B5, B7, B8, B12, B17, B18, B19, B20, B26, B38, B39, B40, B41). In fact, it is difficult to meet service providers' specifications and specific absorption rate (SAR) standards and to minimize effects on the human body while implementing all the bands in one antenna. Thus, service bands, of which the frequency bands are similar to each other over at least two regions, may be lumped with each other so as to implement an antenna. As an example, 2G (GSM850, EGSM, DCS, PCS), WCDMA (B1, B2, B5, B8) and LTE (B1, B2, B3, B4, B5, B8, B12, B17, B18, B19, B20, B26, B39) may be implemented in one antenna, and an antenna for LTE (B7, B38, B40, B41) may be designed in another antenna.

In general, in order to use two antennas and to make the antennas operate in different bands, the antennas are fed with power using different radio frequency (RF) ports (power feeding units), respectively, and in order to minimize an influence therebetween, it is necessary to design each of the antennas so as to secure a maximum spacing distance therebetween.

For example, one antenna may be disposed at the left end of an electronic device, and another antenna may be disposed at the right end of the electronic device. In such a case, when low bands having a low frequency (e.g., B20, B8, B17) are designed to be split to different antennas, respectively, it is difficult to secure a spacing distance of $\lambda/4$ or more ($\lambda/4$ 80 mm @900 MHz), which is the minimum distance to secure an isolation, in view of the fact that the width of an ordinary electronic device (e.g., a smart phone) is about 70 mm to 80 mm. Accordingly, because it is possible to obtain a low band, a penta-band antenna including a low band may be implemented with one antenna and an antenna of high frequency bands (e.g., LTE B7, B38, B40, and B41) is designed in another antenna. However, in such a case, the length of the antennas are relatively short, an antenna performance may be deteriorated by the influence of a human body when the antennas are gripped by a hand.

In addition, in the case where the exterior of an electronic device is constituted with a metallic member (e.g., a metal bezel) according to the recent trend, an antenna is designed using the metallic member as an antenna radiator rather than separately designing the antenna, unlike an injection molded product of a dielectric material. In such a case, since a separate antenna provided within the electronic device is provided to face the metallic member, it is difficult to secure inter-antenna isolation, and the antenna performance of the metallic member may be remarkably deteriorated by the antenna disposed within the electronic device. Further, since the metallic member formed as the exterior of the electronic device is mainly used as an antenna, the antenna performance may be greatly deteriorated under the influence of a human body when the electronic device is gripped by a hand.

Various embodiments of the present disclosure may provide an antenna device which is implemented to secure an efficient mounting space while securing an antenna performance, and an electronic device including the antenna device.

In accordance with an aspect of the present disclosure, an electronic device is provided. The electronic device includes a housing including a first face that faces in a first direction, a second face that faces in a second direction that is opposite to the first direction, and a side face that at least partially encloses a space between the first face and the second face, a conductive member configured to form at least a portion of the side face, and extending in a longitudinal direction, a ground member formed within the housing, at least one communication circuit positioned within the housing, a conductive pattern positioned within the housing and including a portion disposed adjacent to one end of the conductive member, the conductive pattern being electrically connected to the communication circuit and the ground member, a first electric path positioned within the housing, and configured to electrically interconnect a vicinity of another end of the conductive member and the communication circuit, a second electric path configured to electrically interconnect the first electric path or the conductive member and the ground member, and a third electric path configured to electrically interconnect the first electric path or the conductive member and the ground member, and including a switching circuit.

The above information is presented as background information only to assist with an understanding of the present disclosure. No determination has been made, and no assertion is made, as to whether any of the above might be applicable as prior art with regard to the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
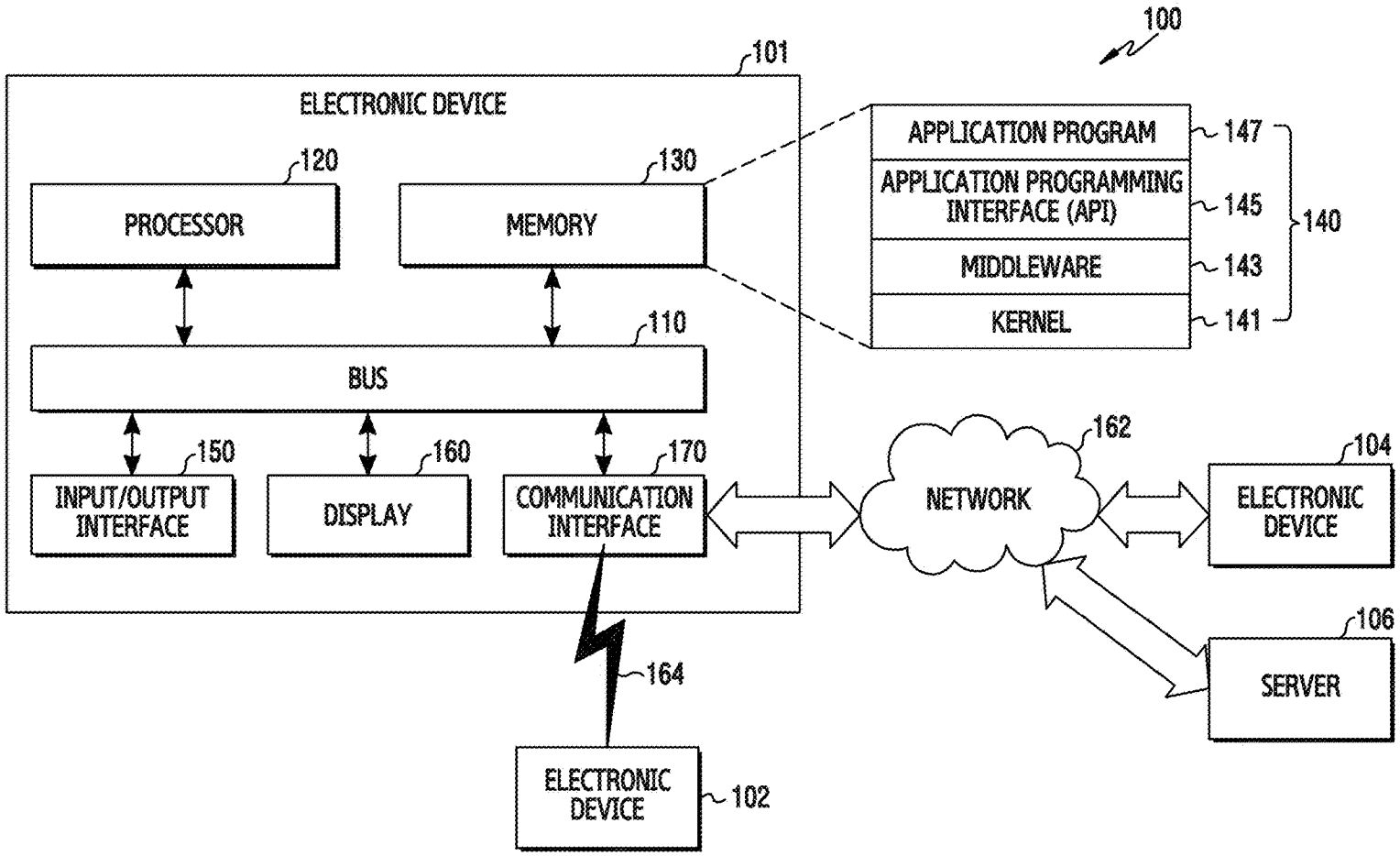
FIG. 1 is a view illustrating a network environment that includes an electronic device according to various embodiments of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Herein, singular forms such as "a," "an," and "the" include plural referents unless the context clearly dictates otherwise. Thus, for example, reference to "a component surface" includes reference to one or more of such surfaces.

The term "substantially" indicates that the recited characteristic, parameter, or value need not be achieved exactly, but that deviations or variations, including, for example, tolerances, measurement error, measurement accuracy limitations and other factors known to those of skill in the art, may occur in amounts that do not preclude the effect the characteristic was intended to provide.

The terms "have," "may have," "include," and "may include" indicate the presence of corresponding features, numbers, functions, parts, operations, elements, etc., but do not limit additional one or more features, numbers, functions, parts, operations, elements, etc.

The terms "A or B," "at least one of A or/and B", and "one or more of A or/and B" may include any and all combinations of words enumerated with it. For example, "A or B," "at least one of A and B", and "at least one of A or B" describe (1) including A, (2) including B, or (3) including both A and B.

Although terms, such as "first" and "second" as used herein may modify various elements of various embodiments of the present disclosure, these terms do not limit the corresponding elements. For example, these terms do not limit an order and/or importance of the corresponding elements. These terms may be used for the purpose of distinguishing one element from another element. For example, a first user device and a second user device both indicate user devices and may indicate different user devices. A first element may be referred to as a second element without departing from the scope of the present disclosure, and similarly, a second element may be referred to as a first element.

When an element (e.g., a first element) is "connected to" or "(operatively or communicatively) coupled with/to" another element (e.g., a second element), the first element may be directly connected or coupled to the second element, or there may be an intervening element (e.g., a third element) between the first element and the second element. However, when the first element is "directly connected" or "directly coupled" to the second element, there is no intervening element between the first element and the second element.

The expression "configured to (or set to)" may be replaced with "suitable for," "having the capacity to," "designed to," "adapted to," "made to," or "capable of" according to the situation. The term "configured to (or set to)" does not necessarily indicate "specifically designed to" in a hardware level. Instead, the expression "an apparatus configured to . . . " may indicate that the apparatus is "capable of . . . " along with other devices or parts in a certain situation. For example, "a processor configured to (set to) perform A, B, and C" may be a dedicated processor, e.g., an embedded processor, for performing a corresponding operation, or a generic-purpose processor, e.g., a central processing unit (CPU) or an application processor (AP), capable of performing a corresponding operation by executing one or more software programs stored in a memory device.

All the terms used herein, including technical and scientific terms, should be interpreted to have the same meanings as commonly understood by those skilled in the art to which the present disclosure pertains, and should not be interpreted to have ideal or excessively formal meanings, unless explicitly defined herein.

A module or programming module may include at least one constituent element among the described constituent elements of an apparatus, or may omit some of them, or may further include additional constituent elements. Operations performed by a module, programming module, or other constituent elements may be executed in a sequential, parallel, repetitive, or heuristic manner. In addition, some of the operations may be executed in a different order or may be omitted, or other operations may be added.

Herein, an electronic device may be a smart phone, a tablet personal computer (PC), a mobile phone, a video phone, an e-book reader, a desktop PC, a laptop PC, a netbook computer, a workstation, a server, a personal digital assistant (PDA), a portable multimedia player (PMP), a moving picture experts group phase 1 or phase 2 (MPEG-1 or MPEG-2) audio layer 3 (MP3) player, a mobile medical device, a camera, or a wearable device (e.g., a head-mounted-device (HMD), electronic glasses, electronic clothing, an electronic bracelet, an electronic necklace, an electronic appcessory, an electronic tattoo, a smart mirror, a smart watch, etc.).

An electronic device may also be a smart home appliance, e.g., a television (TV), a digital versatile disc (DVD) player, an audio component, a refrigerator, an air conditioner, a vacuum cleaner, an oven, a microwave oven, a washing machine, an air cleaner, a set-top box, a home automation control panel, a security control panel, a TV box (e.g., Samsung HomeSync®, Apple TV®, or Google TV®), a game console (e.g., Xbox® or PlayStation®), an electronic dictionary, an electronic key, a camcorder, an electronic frame, and the like.

An electronic device may also be medical equipment, such as a mobile medical device (e.g., a blood glucose monitoring device, a heart rate monitor, a blood pressure monitoring device, a temperature meter, etc.), a magnetic resonance angiography (MRA) machine, a magnetic resonance imaging (MRI) machine, a computed tomography (CT) scanner, an ultrasound machine, etc., a navigation device, a global positioning system (GPS) receiver, an event data recorder (EDR), a flight data recorder (FDR), an in-vehicle infotainment device, electronic equipment for a ship (e.g., a ship navigation equipment and/or a gyrocompass), avionics equipment, security equipment, a head unit for vehicle, an industrial or home robot, an automatic teller machine (ATM), a point of sale (POS) device, or an Internet of things (IoT) device (e.g., a light bulb, various sensors, an electronic meter, a gas meter, a sprinkler, a fire alarm, a thermostat, a streetlamp, a toaster, a sporting equipment, a hot-water tank, a heater, a boiler, etc.)

An electronic device may also be a piece of furniture, a building/structure, an electronic board, an electronic signature receiving device, a projector, and/or various measuring instruments (e.g., a water meter, an electricity meter, a gas meter, a wave meter, and the like).

An electronic device may also be a combination of one or more of the above-mentioned devices. Further, it will be apparent to those skilled in the art that an electronic device is not limited to the above-mentioned examples.

Herein, the term "user" may indicate a person who uses an electronic device or a device (e.g., an artificial intelligence electronic device) that uses the electronic device.

An electronic device of a single radio environment can provide long term evolution (LTE) service using circuit switched fall back (CSFB) that determines whether paging information of a circuit switched (CS) service network is received over an LTE network. When receiving a paging signal of the CS service network over the LTE network, the electronic device connects (or accesses) the CS service network (e.g., a 2nd generation (2G)/3rd generation (3G) network) and provides a voice call service. For example, the 2G network can include one or more of a GSM network and a code division multiple access (CDMA) network. The 3G network can include one or more of a wideband-CDMA (WCDMA) network, a time division-synchronous CDMA (TD-SCDMA) network, and an evolution-data optimized (EV-DO) network.

Alternatively, the electronic device of the single radio environment can provide LTE service using single radio LTE (SRLTE), which determines whether the paging information is received by periodically switching every radio resource (e.g., receive antennas) to the CS service network (e.g., the 2G/3G network). Upon receiving the paging signal of the CS service network, the electronic device provides the voice call service by connecting the CS service network (e.g., the 2G/3G network).

Alternatively, the electronic device of the single radio environment can provide LTE service using single radio dual system (SRDS), which determines whether the paging information is received by periodically switching some of radio resources (e.g., receive antennas) to the CS service network (e.g., the 2G/3G network). Upon receiving the paging signal of the CS service network, the electronic device provides the voice call service by connecting the CS service network (e.g., the 2G/3G network).

FIG. 1 illustrates a network environment 100 including an electronic device according to an embodiment of the present disclosure.

Referring to FIG. 1, an electronic device 101 includes a bus 110, a processor 120, a memory 130, an input/output interface 150, a display 160, and a communication interface 170. Alternatively, the electronic device 101 can omit at least one of the components and/or include an additional component.

The bus 110 includes a circuit for connecting the components (e.g., the processor 120, the memory 130, the input/output interface 150, the display 160, and the communication interface 170) and delivering communications (e.g., a control message) therebetween.

The processor 120 includes one or more of a CPU, an AP, and a communication processor (CP). The processor 120 processes an operation or data for control of and/or communication with another component of the electronic device 101.

The processor 120, which may be connected to the LTE network, determines whether a call is connected over the CS service network using caller identification information (e.g., a caller phone number) of the CS service network (e.g., the 2G/3G network). For example, the processor 120 may receive incoming call information (e.g., a CS notification message or a paging request message) of the CS service network over the LTE network (e.g., CSFB). For example, the processor 120 being connected to the LTE network may receive incoming call information (e.g., a paging request message) over the CS service network (e.g., SRLTE).

When receiving the incoming call information (e.g., a CS notification message or a paging request message) of the CS service network over the LTE network, the processor 120 may obtain caller identification information from the incoming call information. The processor 120 displays the caller identification information on its display 160. The processor 120 may determine whether to connect the call based on input information corresponding to the caller identification information displayed on the display 160. For example, when detecting input information corresponding to an incoming call rejection, through the input/output interface 150, the processor 120 may restrict the voice call connection and maintains the LTE network connection. For example, when detecting input information corresponding to an incoming call acceptance, through the input/output interface 150, the processor 120 connects the voice call by connecting to the CS service network.

When receiving the incoming call information (e.g., a CS notification message or a paging request message) of the CS service network over the LTE network, the processor 120 may obtain caller identification information from the incoming call information. The processor 120 may determine whether to connect the call by comparing the caller identification information with a reception control list. For example, when the caller identification information is included in a first reception control list (e.g., a blacklist), the processor 120 may restrict the voice call connection and maintains the connection to the LTE network. For example, when the caller identification information is not included in the first reception control list (e.g., the blacklist), the processor 120 may connect the voice call by connecting to the CS service network. For example, when the caller identification information is included in a second reception control list (e.g., a white list), the processor 120 connects the voice call by connecting to the CS service network.

When receiving the incoming call information (e.g., a paging request message) of the CS service network over the LTE network, the processor 120 may transmit an incoming call response message (e.g., a paging response message) to the CS service network. The processor 120 may suspend the LTE service and receives the caller identification information (e.g., a CS call (CC) setup message) from the CS service network. The processor 120 may determine whether to connect the call by comparing the caller identification information with the reception control list. For example, when the caller identification information is included in the first reception control list (e.g., the blacklist), the processor 120 may restrict the voice call connection and resumes the LTE network connection. For example, when the caller identification information is not included in the first reception control list (e.g., the blacklist), the processor 120 may connect the voice call by connecting to the CS service network. For example, when the caller identification information is included in the second reception control list (e.g., the white list), the processor 120 connects the voice call by connecting to the CS service network.

The memory 130 may include volatile and/or nonvolatile memory. The memory 130 may store commands or data (e.g., the reception control list) relating to at least another component of the electronic device 101. The memory 130 stores software and/or a program 140. The program 140 includes a kernel 141, middleware 143, an application programming interface (API) 145, and applications 147. At least some of the kernel 141, the middleware 143, and the API 145 may be referred to as an operating system (OS).

The kernel 141 may control or manage system resources (e.g., the bus 110, the processor 120, or the memory 130) used for performing an operation or function implemented by the other programs (e.g., the middleware 143, the API 145, or the applications 147). Further, the kernel 141 provides an interface through which the middleware 143, the API 145, or the applications 147 may connect the individual elements of the electronic device 101 to control or manage the system resources.

The middleware 143 may function as an intermediary for the API 145 or the applications 147 to communicate with the kernel 141 and exchange data. In addition, the middleware 143 may process one or more task requests received from the applications 147 according to priorities thereof. For example, the middleware 143 may assign priorities for using the system resources (e.g., the bus 110, the processor 120, the memory 130, and the like) of the electronic device 101, to at least one of the applications 147. For example, the middleware 143 may perform scheduling or load balancing on the one or more task requests by processing the one or more task requests according to the priorities assigned thereto.

The API 145 is an interface through which the applications 147 control functions provided from the kernel 141 or the middleware 143, and may include at least one interface or function (e.g., an instruction) for file control, window control, image processing, text control, etc.

The input/output interface 150 transfers instructions or data input from a user or another external device to the other element(s) of the electronic device 101. Further, the input/output interface 150 outputs the instructions or data received from the other element(s) of the electronic device 101 to the user, a first external electronic device 102, a second external electronic device 104, or a server 106.

The display 160 may include a liquid crystal display (LCD), a light emitting diode (LED) display, an organic LED (OLED) display, a micro electro mechanical system (MEMS) display, an electronic paper display, etc. The display 160 displays various types of content (e.g., a text, images, videos, icons, symbols, webpages, etc.) for the user. The display 160 may include a touch screen that receives a touch input, a gesture input, a proximity input, a hovering input, etc., from an electronic pen or the user's body part.

The communication interface 170 establishes communication between the electronic device 101 and the first external electronic device 102, the second external electronic device 104, or the server 106. For example, the communication interface 170 can communicate with the first external electronic device 102 through a wireless communication or a wired communication 164, and communicate with the second external electronic device 104 or the server 106 in connection to a network 162 through wireless communication or wired communication. For example, the wireless communication 164 may conform to a cellular communication protocol including at least one of LTE, LTE-advanced (LTE-A), code division multiple access (CDMA), wideband CDMA (WCDMA), universal mobile telecommunications system (UMTS), wireless broadband (WiBro), and GSM.

The wired communication 164 can include at least one of universal serial bus (USB), high definition multimedia interface (HDMI), recommended standard 232 (RS-232), and plain old telephone service (POTS).

The network 162 may include a telecommunications networks, a computer network (e.g., a local area network (LAN) or a wide area network (WAN)), the Internet, a telephone network, etc.

The electronic device 101 provides the LTE service in the single radio environment by use of at least one module functionally or physically separated from the processor 120.

Various embodiments of the present disclosure will be described with reference to a display that includes a bent or curved area and is applied to a housing of an electronic device 101, in which a non-metal member and a metal member (e.g., a metal bezel) are formed through dual injection molding, but are not limited thereto. For example, the display 160 may be applied to a housing, in which a metal member or a non-metal member is formed of a single material.

Each of the first external electronic device 102 and the second external electronic device 104 may be a same or a different type of device as the electronic device 101.

The server 106 may include a group of one or more servers.

All or some of the operations to be executed by the electronic device 101 may be executed by the first external electronic device 102, the second external electronic device 104, and/or the server 106. For example, when the electronic device 101 should perform a certain function, the electronic device 101 may request some functions that are associated therewith from the first external electronic device 102, the second external electronic device 104, and/or the server 106, instead of or in addition to executing the function or service by itself. The first external electronic device 102, the second external electronic device 104, or the server 106 may execute the requested functions or additional functions, and may transmit the results to the electronic device 101. The electronic device 101 may provide the requested functions or services by processing the received results as they are or after additionally. For example, a cloud computing technique, a distributed computing technique, ora client-server computing technique may be used.

Figure 2A:
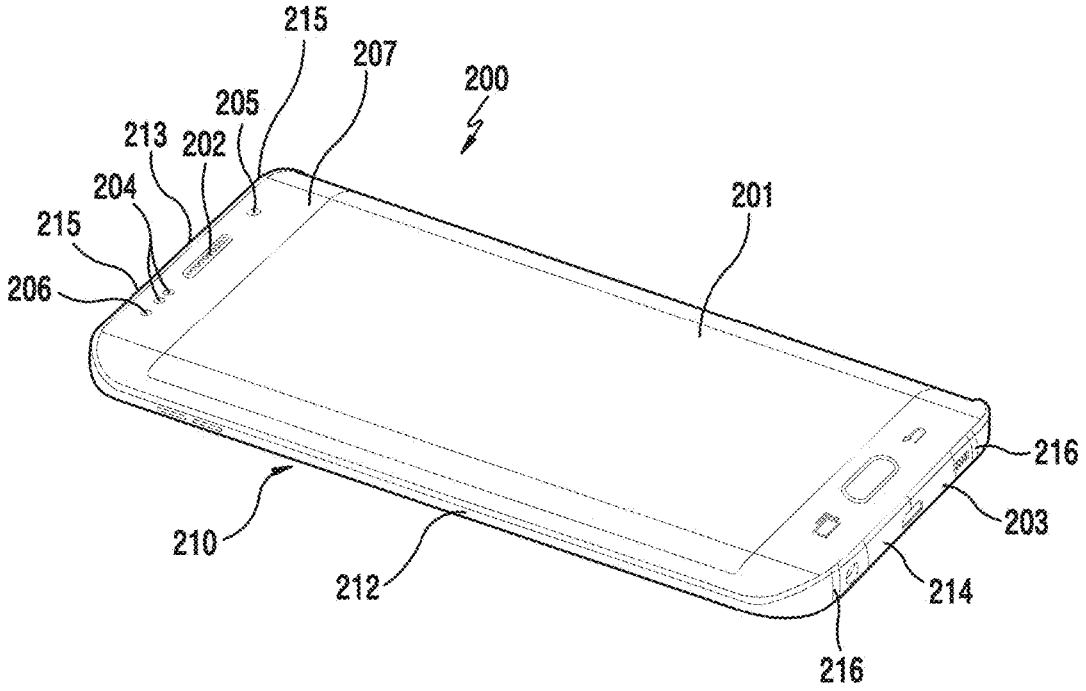
FIG. 2A is a perspective view illustrating a front side of the electronic device according to various embodiments of the present disclosure.

FIG. 2A is a perspective view illustrating a front side of the electronic device 200 according to various embodiments of the present disclosure.

Referring to FIG. 2A, a display 201 may be provided on the front face 207 of the electronic device 200. A speaker device 202 may be installed above the display 201 so as to receive a voice of a counterpart. A microphone device 203 may be installed below the display 201 so as to transmit a voice of the user of the electronic device.

According to an embodiment, components for conducting various functions of the electronic device 200 may be arranged around the speaker device 202. The components may include one or more sensor modules 204. The sensor modules 204 may include at least one of, for example, an illuminance sensor (e.g., an optical sensor), a proximity sensor, an infrared sensor, and an ultrasonic sensor. According to an embodiment, the components may include a camera device 205. According to an embodiment, the components may include an LED indicator 206 that informs the user of the status information of the electronic device 200.

According to various embodiments, the electronic device 200 may include a metal bezel 210 (that may serve as at least a partial region of, for example, a metal housing). According to an embodiment, the metal bezel 210 may be arranged along the rim of the electronic device 200, and may be disposed to expand to at least a partial region of the rear face of the electronic device 200 that extends from the rim. According to an embodiment, the metal bezel 210 is defined by the thickness of the electronic device 200 along the rim of the electronic device 200, and may be formed in a closed loop shape. Without being limited thereto, however, the metal bezel 210 may be formed to serve as at least a portion of the thickness of the electronic device 200. According to an embodiment, the metal bezel 210 may be formed on only a portion of the rim of the electronic device 200. According to an embodiment, the metal bezel 210 may include one or more split portions 215 and 216 such that each of the unit bezel sections 213 and 214, which are separated by the split portions 215 and 216, may be used as an antenna radiator according to an embodiment of the present disclosure.

Figure 2B:
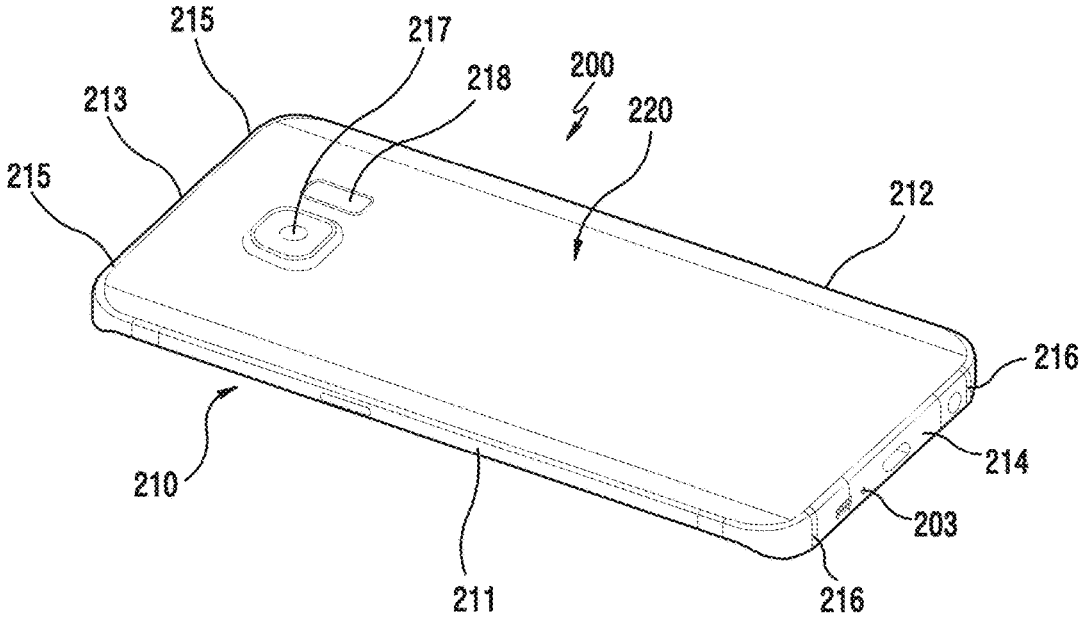
FIG. 2B is a perspective view illustrating a rear side of the electronic device according to various embodiments of the present disclosure.

FIG. 2B is a perspective view illustrating a rear side of the electronic device 200 according to various embodiments of the present disclosure.

Referring to FIG. 2B, a cover member 220 may be further provided on the rear face of the electronic device 200. The cover member 220 may be a battery cover that protects a battery pack, which is removably installed to the electronic device 200 and makes the external appearance of the electronic device 200 beautiful. Without being limited thereto, however, the cover member 220 may be integrated with the electronic device 200 to serve as a rear housing of the electronic device 200. According to an embodiment, the cover member 220 may be formed of various materials (e.g., a metal, glass, a composite material, and a synthetic resin). According to an embodiment, a camera device 217 and a flash 218 may be disposed on the rear face of the electronic device 200.

According to various embodiments, among the metal bezels 210 arranged to enclose the rim of the electronic device 200, the lower bezel section 214 to be used as a unit bezel may be used as one antenna radiator in a composite antenna device according to an embodiment of the present disclosure. According to an embodiment, the lower bezel section 214 may be disposed such that another antenna radiator disposed near the lower bezel section 214 is coupled to the lower bezel section 214.

According to various embodiments, the metal bezel 210 may have a loop shape along the rim, and may be arranged to serve as the whole or a part of the thickness of the electronic device 200. According to an embodiment, when viewed from the front side of the electronic device 200, the metal bezel 210 may include a right bezel section 211, a left bezel section 212, an upper bezel section 213, and a lower bezel section 214. Here, the above-mentioned unit bezel sections 213 and 214 may serve as unit bezel sections that are formed by the split portions 215 and 216.

Figure 2C:
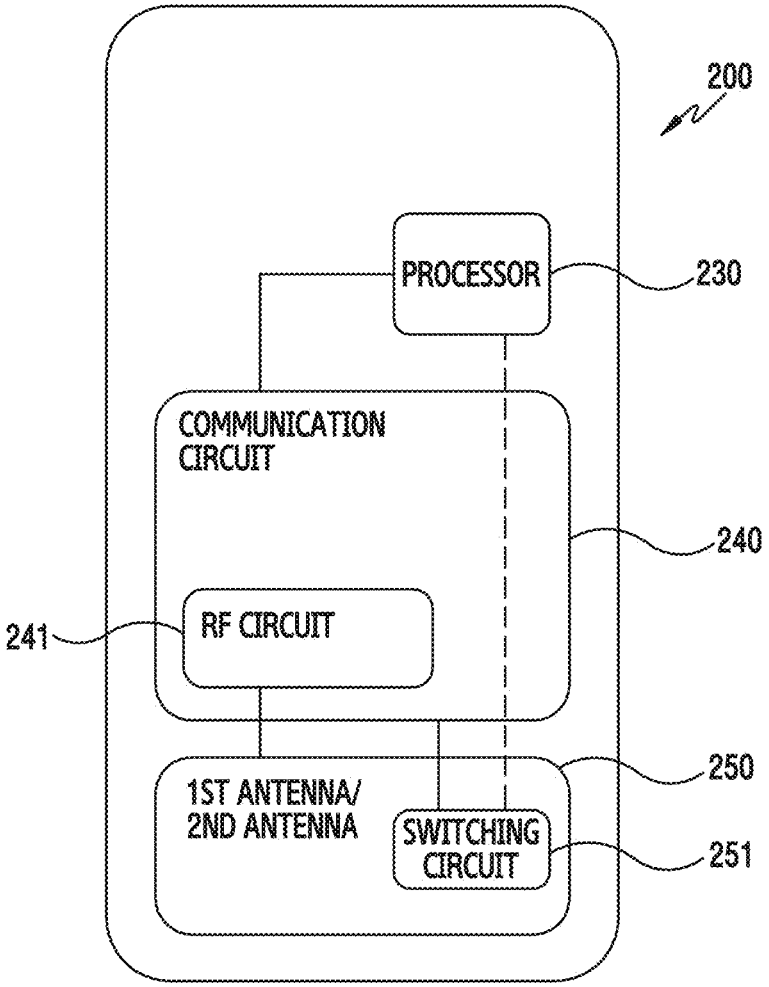
FIG. 2C is a block diagram illustrating a configuration of an antenna device for controlling an operating band of an antenna device according to various embodiments of the present disclosure.

FIG. 2C is a block diagram illustrating a configuration of an antenna device for controlling an operating band of an antenna device according to various embodiments of the present disclosure.

Referring to FIG. 2C, the electronic device may include a processor 230, a communication module/circuit 240 controlled by the processor 230, and an antenna section 250 controlled by the processor 230 or the communication module/circuit 240.

According to various embodiments, the communication module/circuit 240 may have a configuration that is the same as, or similar to, the communication interface 170 of FIG. 1. The communication module/circuit 240 may include, for example, at least one of a cellular module, a Wi-Fi module, a Bluetooth module, a GNSS module (e.g., a GPS module, a Glonass module, a Beidou module, or a Galileo module), an near field communication (NFC) module, and a radio frequency (RF) module.

According to various embodiments, the RF module/circuit 241 may transmit/receive a communication signal (e.g., an RF signal). The RF module/circuit 241 may include, for example, a transceiver, a power amp module (PAM), a frequency filter, a low noise amplifier (LNA), or an antenna.

According to various embodiments, the antenna section 250 may include at least to antenna radiators according to embodiments of the present disclosure. According to an embodiment, the antenna section 250 may include a conductive member that is used as a portion of the electronic device 200 and is electrically connected to the RF module/circuit 241 to operate as a first antenna radiator. According to an embodiment, the antenna section 250 may include a conductive pattern that is disposed within the electronic device 200 and is electrically connected to the RF module/circuit 241 to operate as a second antenna radiator. According to an embodiment, the antenna section 250 may include a switching circuit 251 that is branched from an electric path that electrically interconnects the communication module/circuit 240 and the conductive member.

According to various embodiments, the antenna section 250 may change the operating frequency bands or bandwidths of the conductive member that operates as the first antenna radiator and/or the conductive pattern that operates as the second antenna radiator according to the switching operation of the switching circuit 251 that is operated under the control of the communication module/circuit 240 or the processor 230.

Figure 3:
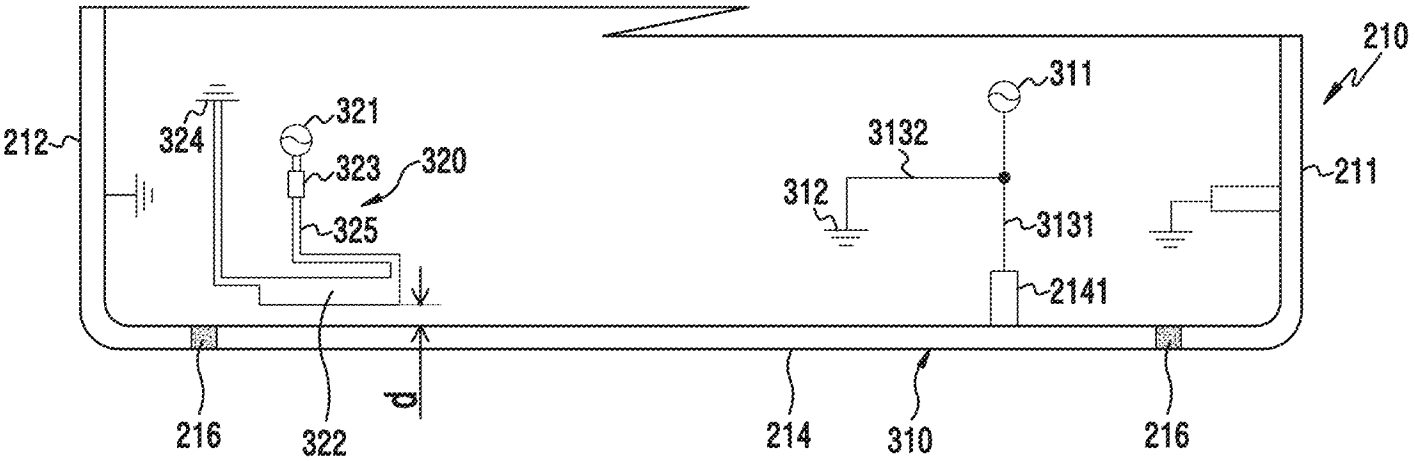
FIG. 3 is a diagram illustrating a configuration of an antenna device according to various embodiments of the present disclosure.

FIG. 3 is a diagram illustrating a configuration of an antenna device according to various embodiments of the present disclosure.

Referring to FIG. 3, a composite antenna device according to an embodiment of the present disclosure may include a first antenna radiator 310 and a second antenna radiator 320 coupled with the first antenna radiator 310 to operate. According to an embodiment, the first antenna radiator 310 may be a conductive member that serves as a portion of the electronic device. According to an embodiment, the second antenna radiator 320 may be a conductive pattern that is disposed within the electronic device.

According to various embodiments, the lower bezel section 214 disposed to be separated by a pair of split portions 216 from the metal bezel 210 may be used as the first antenna radiator 310. For example, the lower bezel section 214 may be maintained in the state of being electrically insulated from the left bezel section 212 and the right bezel section 211 in the metal bezel 210 by a pair of split portions 216.

According to an embodiment, a proper location in the lower bezel section 214 may be configured to be fed with power from a first power feeding unit 311 disposed within the electronic device 200. According to an embodiment, the first power feeding unit 311 may be disposed on a printed circuit board (PCB) of the electronic device, and may be directly electrically connected by a conductive connection piece 2141 that is formed to be drawn out from the lower bezel section 214 toward the board. According to an embodiment, the connection piece 2141 may be electrically connected to the first power feeding unit 311 by a first electric path 3131 (e.g., a wiring line) in a region of the board, which is nearest to the connection piece 2141. According to an embodiment, the connection piece 2141 and the first electric path 3131 may be electrically connected to each other by a separate electric connection member. According to an embodiment, one or more various members (e.g., a thin wire cable, a flexible printed circuit, a C-clip, or a conductive gasket) may be used as the electric connection member. According to an embodiment, the electric connection member may be grounded to the first ground portion 312 through a second electric path 3132 (e.g., a wiring line) branched from the first electric path 3131.

According to various embodiments, the second antenna radiator 320 may be disposed within the electronic device. According to an embodiment, the second antenna radiator 320 may be disposed to face the lower bezel section 214 that is used as the first antenna radiator 310, and may be disposed at a position where it can be coupled to the lower bezel section 214.

According to an embodiment, the second antenna radiator 320 may be formed on a board (a main board and/or a sub board) in a pattern manner. Without being limited thereto, however, the second antenna radiator 320 may be disposed in a region other than the board. According to an embodiment, the second antenna radiator 320 may be a metal plate that has a flexible printed circuit or pattern that includes a pattern that is disposed in a region other than the board and operates in a specific frequency band. According to an embodiment, the second antenna radiator 320 may be attached to the inner face of the housing of the electronic device. According to an embodiment, in the case where the second antenna radiator 320 is a metal plate, the second antenna radiator 320 may be insert molded in the outer face, the inner face, or the inside of the housing that is formed of a synthetic resin material. According to an embodiment, the second antenna radiator 320 may be a conductive paint that is coated on the inner face or the outer face of the housing of the electronic device. According to an embodiment, the second antenna radiator 320 may be disposed on an antenna carrier made of a synthetic resin material.

According to an embodiment, the second antenna radiator 320 may be fed with power from the second power feeding unit 321 of the board. According to an embodiment, the second antenna radiator 320 may include a radiating unit 322. According to an embodiment, the radiating unit 322 may be disposed at a position where it can be coupled with the lower bezel section 214. According to an embodiment, the radiating unit 322 may be electrically connected to the second power feeding unit 321 by a predetermined wiring line 325. According to an embodiment, in such a case, at least one matching element 323 may be interposed in the wiring line 325 between the second power feeding unit 321 and the radiating unit 322 in order to tune the operating frequency band of the second antenna radiator 320. According to an embodiment, the wiring line 325 drawn out from the radiating unit 322 is grounded to the second ground portion 324 of the board such that the second antenna radiator 320 may be implemented as a loop type antenna that extends from the second power feeding unit 321 through the radiating unit 322 and is connected to the second ground portion 324 through the wiring line 325.

According to various embodiments, the second antenna radiator 320 may adjust the resonance frequency and the bandwidth thereof by adjusting the distance d between the radiating unit 322 and the lower bezel section 214, the thickness of a pattern of the radiating unit 322 formed on the board, and a coupling region between the radiating unit 322 and the lower bezel section 214.

According to various embodiments, the second antenna radiator 320, operates in a higher frequency band than the first antenna radiator 310, has a relatively short electric length of the radiation pattern, which may cause the second antenna radiator 320 to sensitively receive the influence of a human body upon being gripped, thereby degrading the radiating performance antenna. However, in an embodiment of the present disclosure, the second antenna radiator 320 is disposed at a position where it is coupled with the first antenna radiator, which may cause the second antenna radiator 320 to insensitively operate with respect to the influence of a human body, thereby preventing the degradation of the radiating performance in advance.

Figure 4A:
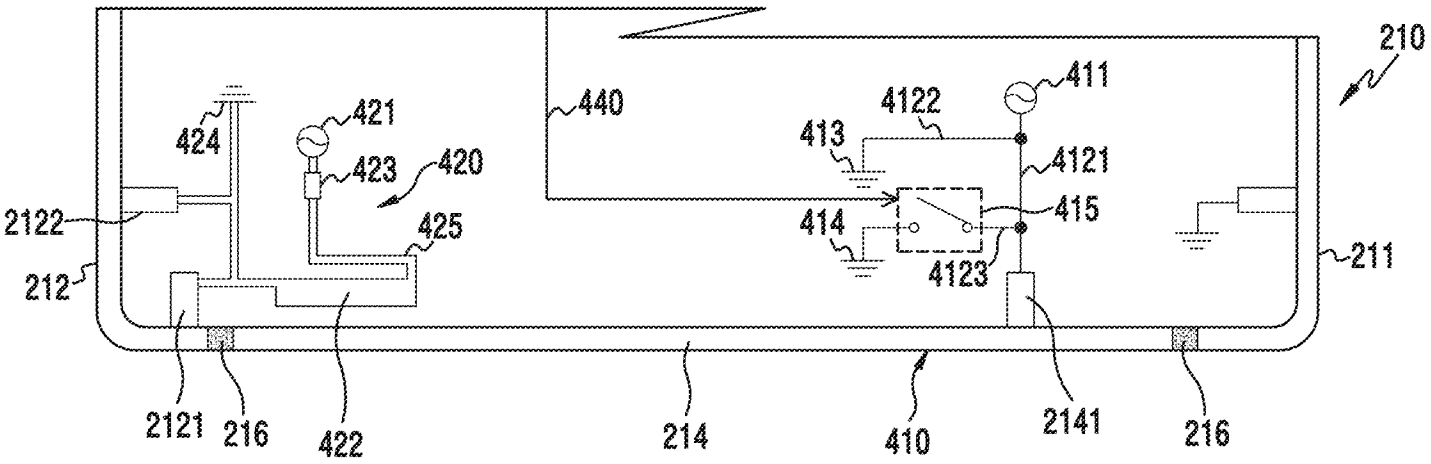
FIGS. 4A, 4B, and 4C are diagrams illustrating configurations of antenna devices according to various embodiments of the present disclosure.
Figure 4B:
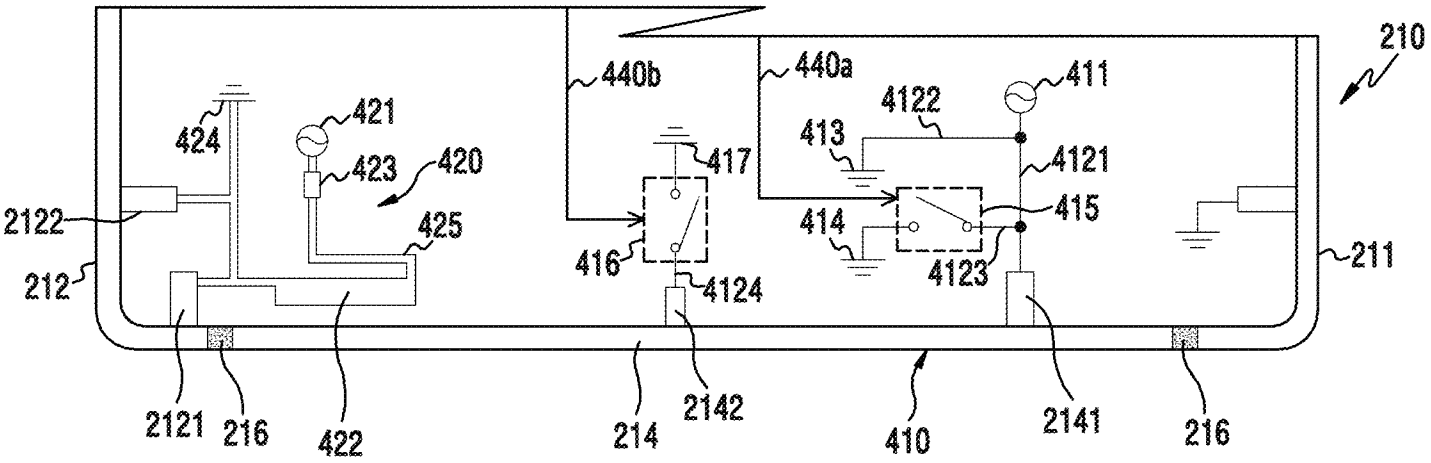
Figure 4C:
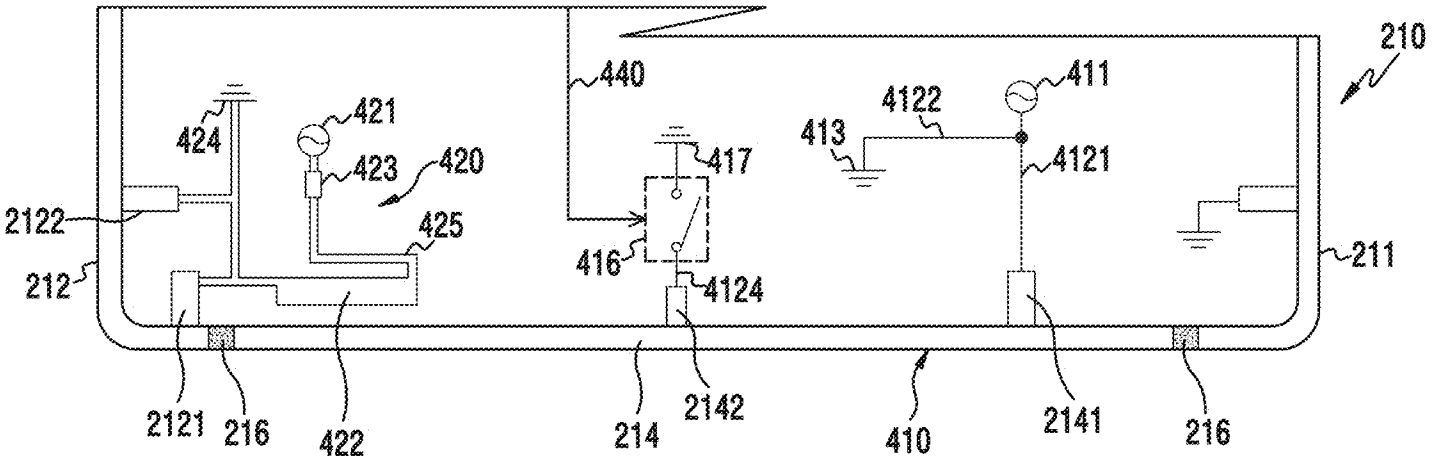

FIGS. 4A, 4B and 4C are diagrams illustrating configurations of antenna devices according to various embodiments of the present disclosure.

Referring to FIG. 4A, a composite antenna device according to an embodiment of the present disclosure may include a first antenna radiator 410 and a second antenna radiator 420 coupled with the first antenna radiator 410 to operate. According to an embodiment, the first antenna radiator 410 may be a conductive member that serves as a portion of the electronic device. According to an embodiment, the second antenna radiator 420 may be a conductive pattern that is disposed within the electronic device.

According to various embodiments, the lower bezel section 214 disposed to be separated by a pair of split portions 216 from the metal bezel 210 may be used as the first antenna radiator 410. For example, the lower bezel section 214 may be maintained in the state of being electrically insulated from the left bezel section 212 and the right bezel section 211 in the metal bezel 210 by a pair of split portions 216.

According to an embodiment, a proper location in the lower bezel section 214 may be configured to be fed with power from a first power feeding unit 411 disposed within the electronic device. According to an embodiment, the first power feeding unit 411 may be disposed on a board PCB 430 of the electronic device, and may be directly electrically connected by a first conductive connection piece 2141 that is formed to be drawn out from the lower bezel section 214 toward the board 430. According to an embodiment, the first connection piece 2141 may be electrically connected to the first power feeding unit 411 by a first electric path 4121 (e.g., a wiring line) in a region of the board (430 of FIG. 5), which is nearest to the first connection piece 2141. According to an embodiment, the first connection piece 2141 and the first electric path 4121 may be electrically connected to each other by a separate electric connection member. According to an embodiment, one or more various members (e.g., a thin wire cable, a flexible printed circuit, a C-clip, or a conductive gasket) may be used as the electric connection member.

According to various embodiments, the first electric path 4121 is branched to the second electric path 4122 and the third electric path 4123 at different positions so as to be grounded to the first ground portion 413 and the second ground portion 414, respectively. According to an embodiment, a switch 415 may be further interposed in the third electric path 4123 to which the second ground portion 414 is connected. According to an embodiment, the first antenna radiator 410 may operate in a state where the second ground portion 414 is electrically connected to or cut off from the lower bezel section 214 depending on the switching operation of the switch 415. According to an embodiment, the resonance length of the first antenna radiator 410 is variable depending on the switching operation of the switch 415 by a control flow 440 of the communication circuit 240 or the processor 230 of the electronic device 200, which may cause the operation frequency band to be changed or may cause the bandwidth thereof to be expanded.

According to various embodiments, the second antenna radiator 420 may be disposed within the electronic device. According to an embodiment, the second antenna radiator 420 may be disposed to face the lower bezel section 214 that is used as the first antenna radiator 410, and may be disposed at a position where it can be coupled to the lower bezel section 214.

According to an embodiment, the second antenna radiator 420 may be formed on a board 430 (a main board and/or a sub board) in a pattern manner. Without being limited thereto, however, the second antenna radiator 420 may be disposed in a region other than the board 430. According to an embodiment, the second antenna radiator 420 may be a metal plate that has a flexible printed circuit or pattern that includes a pattern that is disposed in a region other than the board and operates in a specific frequency band. According to an embodiment, the second antenna radiator 420 may be attached to the inner face of the housing of the electronic device. According to an embodiment, in the case where the second antenna radiator 420 is a metal plate, the second antenna radiator 420 may be insert molded in the outer face, the inner face, or the inside of the housing that is formed of a synthetic resin material. According to an embodiment, the second antenna radiator 420 may be a conductive paint that is coated on the inner face or the outer face of the housing of the electronic device. According to an embodiment, the second antenna radiator 420 may be disposed on an antenna carrier made of a synthetic resin material.

According to an embodiment, the second antenna radiator 420 may be fed with power from the second power feeding unit 421 of the board 430. According to an embodiment, the second antenna radiator 420 may include a radiating unit 422. According to an embodiment, the radiating unit 422 may be disposed at a position where it can be coupled with the lower bezel section 214. According to an embodiment, the radiating unit 422 may be electrically connected to the second power feeding unit 421 by a predetermined wiring line 425. According to an embodiment, in such a case, at least one matching element 423 may be interposed in the wiring line 425 between the second power feeding unit 421 and the radiating unit 422 in order to tune the operating frequency band of the second antenna radiator 420.

Referring to FIG. 4B, a composite antenna device according to an embodiment of the present disclosure may include a first antenna radiator 410 and a second antenna radiator 420 coupled with the first antenna radiator 410 to operate. According to an embodiment, the first antenna radiator 410 may be a conductive member that serves as a portion of the electronic device. According to an embodiment, the second antenna radiator 420 may be a conductive pattern that is disposed within the electronic device.

According to various embodiments, the lower bezel section 214 disposed to be separated by a pair of split portions 216 from the metal bezel 210 may be used as the first antenna radiator 410. For example, the lower bezel section 214 may be maintained in the state of being electrically insulated from the left bezel section 212 and the right bezel section 211 in the metal bezel 210 by a pair of split portions 216.

According to an embodiment, a proper location in the lower bezel section 214 may be configured to be fed with power from a first power feeding unit 411 disposed within the electronic device. According to an embodiment, the first power feeding unit 411 may be disposed on a board PCB 430 of the electronic device, and may be directly electrically connected by a first conductive connection piece 2141 that is formed to be drawn out from the lower bezel section 214 toward the board 430. According to an embodiment, the first connection piece 2141 may be electrically connected to the first power feeding unit 411 by a first electric path 4121 (e.g., a wiring line) in a region of the board (430 of FIG. 5), which is nearest to the first connection piece 2141. According to an embodiment, the first connection piece 2141 and the first electric path 4121 may be electrically connected to each other by a separate electric connection member. According to an embodiment, one or more various members (e.g., a thin wire cable, a flexible printed circuit, a C-clip, or a conductive gasket) may be used as the electric connection member.

According to various embodiments, the first electric path 4121 is branched to the second electric path 4122 and the third electric path 4123 at different positions so as to be grounded to the first ground portion 413 and the second ground portion 414, respectively. According to an embodiment, a first switch 415 may be further interposed in the third electric path 4123 to which the second ground portion 414 is connected. According to an embodiment, the first antenna radiator 410 may operate in a state where the second ground portion 414 is electrically connected to or cut off from the lower bezel section 214 depending on the switching operation of the first switch 415. According to an embodiment, the resonance length of the first antenna radiator 410 is variable depending on the switching operation of the first switch 415 by a control flow 440*a* of the communication circuit 240 or the processor 230 of the electronic device 200, which may cause the operation frequency band to be changed or may cause the bandwidth thereof to be expanded.

According to various embodiments, a fourth connection piece 2142 may be formed in the lower bezel section 214, and the fourth connection piece 2142 may be electrically connected to a fourth ground portion 417 via a fourth electric path 4124. According to an embodiment, a second switch 416 is interposed in the fourth electric path 4124 such that the resonance length of the first antenna radiator 410 is variable depending on the switching operation of the second switch 416 by a control flow 440*b* of the communication circuit 240 or the processor 230 of the electronic device 200, which may cause the operation frequency band to be changed or may cause the bandwidth thereof to be expanded.

According to various embodiments, the communication circuit 240 or the processor 230 may control the first switch 415 and the second switch 416 simultaneously or individually.

Referring to FIG. 4C, a composite antenna device according to an embodiment of the present disclosure may include a first antenna radiator 410 and a second antenna radiator 420 coupled with the first antenna radiator 410 to operate. According to an embodiment, the first antenna radiator 410 may be a conductive member that serves as a portion of the electronic device. According to an embodiment, the second antenna radiator 420 may be a conductive pattern that is disposed within the electronic device.

According to various embodiments, the lower bezel section 214 disposed to be separated by a pair of split portions 216 from the metal bezel 210 may be used as the first antenna radiator 410. For example, the lower bezel section 214 may be maintained in the state of being electrically insulated from the left bezel section 212 and the right bezel section 211 in the metal bezel 210 by a pair of split portions 216.

According to an embodiment, a proper location in the lower bezel section 214 may be configured to be fed with power from a first power feeding unit 411 disposed within the electronic device. According to an embodiment, the first power feeding unit 411 may be disposed on a board PCB 430 of the electronic device, and may be directly electrically connected by a first conductive connection piece 2141 that is formed to be drawn out from the lower bezel section 214 toward the board 430. According to an embodiment, the first connection piece 2141 may be electrically connected to the first power feeding unit 411 by a first electric path 4121 (e.g., a wiring line) in a region of the board (430 of FIG. 5), which is nearest to the first connection piece 2141. According to an embodiment, the first connection piece 2141 and the first electric path 4121 may be electrically connected to each other by a separate electric connection member. According to an embodiment, one or more various members (e.g., a thin wire cable, a flexible printed circuit, a C-clip, or a conductive gasket) may be used as the electric connection member. According to an embodiment, the first electric path 4121 may be branched to a second electric path 4122 to be grounded to the first ground portion 413.

According to various embodiments, a fourth connection piece 2142 may be formed in the lower bezel section 214, and the fourth connection piece 2142 may be electrically connected to a fourth ground portion 417 via a fourth electric path 4124. According to an embodiment, a switch 416 is interposed in the fourth electric path 4124 such that the resonance length of the first antenna radiator 410 is variable depending on the switching operation of the switch 416 by a control flow 440 of the communication module/circuit 240 or the processor 230 of the electronic device 200, which may cause the operation frequency band to be changed or may cause the bandwidth thereof to be expanded.

Figure 5:
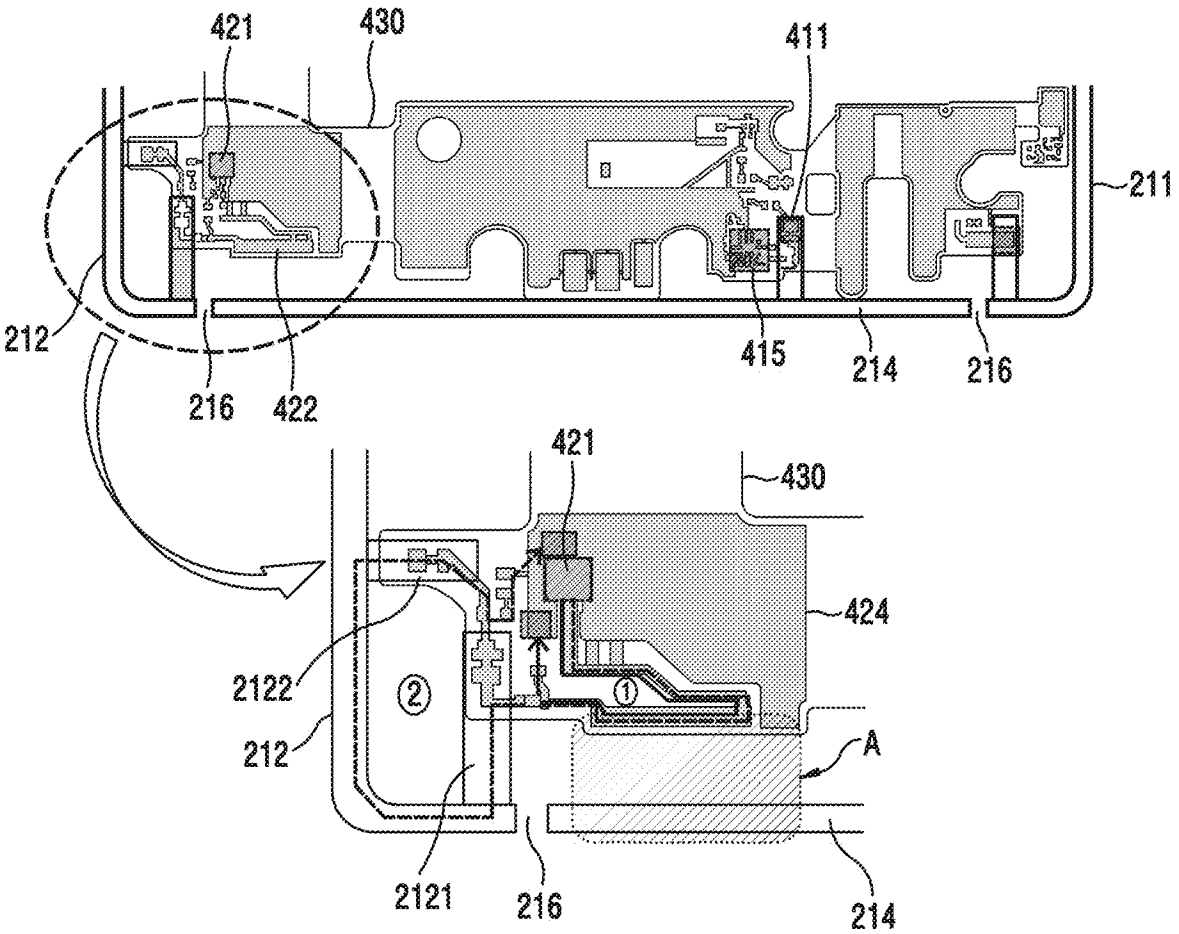
FIG. 5 is a diagram illustrating a configuration of an antenna device according to various embodiments of the present disclosure.

FIG. 5 is a diagram illustrating a configuration of an antenna device according to various embodiments of the present disclosure.

Referring to FIGS. 4A, 4B, 4C and 5, one of the wiring lines 425 drawn out from the radiating unit 422 is grounded to the third ground portion 424 of the board such that the second antenna radiator 420 may include a first loop type radiation region (region ① in FIG. 5) that is connected to the third ground portion 424 from the second power feeding unit 421 through the radiating unit 422.

According to an embodiment, the second antenna radiator 420 may include a second loop type radiation region (region ② in FIG. 5) that is electrically connected with the second connection piece 2121 of the left bezel section 212 from the radiating unit 422 in the wiring line. In the second loop type radiation region (region ② in FIG. 5), a third connection piece 2122, which is spaced apart from the second connection piece 2121, is electrically connected to the third ground portion 424 again. Accordingly, the second antenna radiator 420 may generate dual resonances, and various bandwidths can be secured from one antenna radiator by tuning the second antenna radiator 420 to operate in different frequency bands.

According to various embodiments, the second antenna radiator 420 may adjust the resonance frequency and the bandwidth thereof by adjusting the distance between the radiating unit 422 and the lower bezel section 214, the thickness of a pattern of the radiating unit 422 formed on the board, and a coupling region between the radiating unit 422 and the lower bezel section 214.

Figure 6:
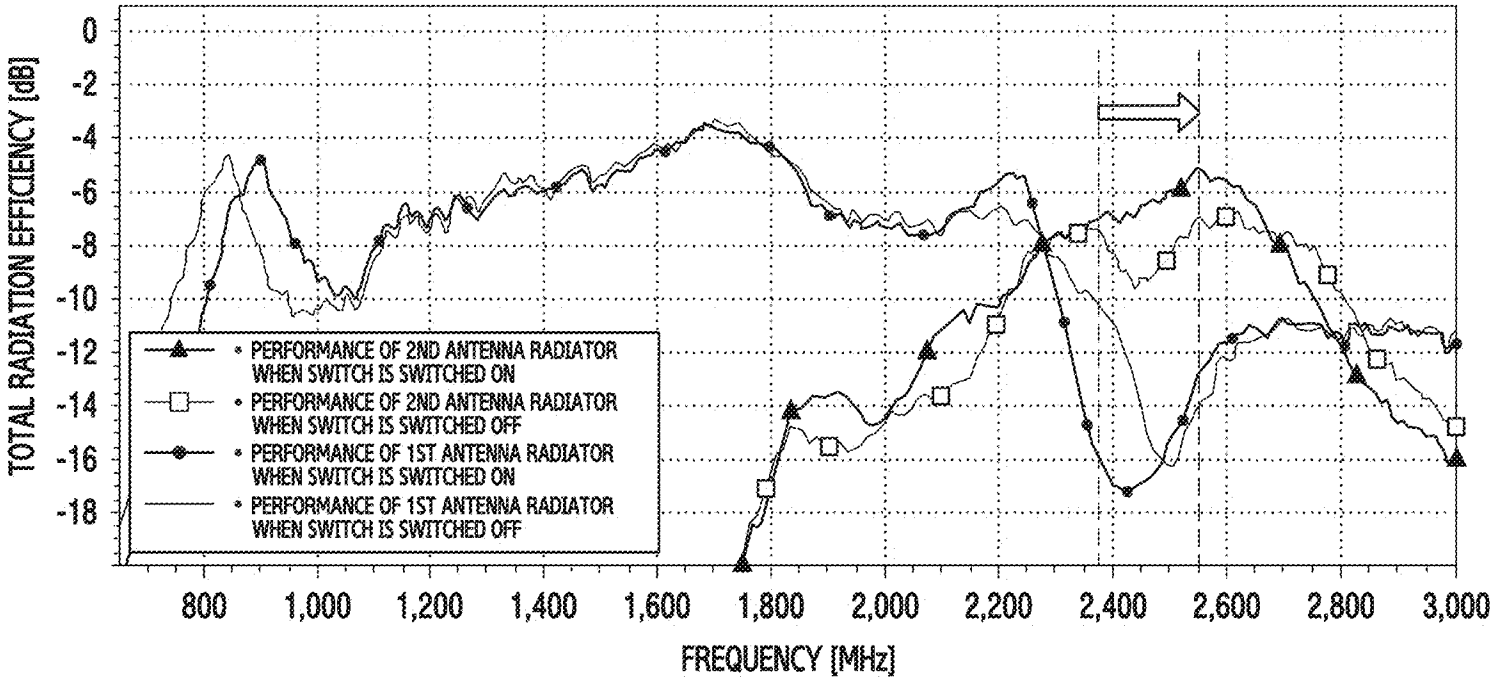
FIG. 6 is a graph representing an efficiency related to a gain of each frequency of a first antenna radiator and a second antenna radiator according to a ground switching of the first antenna radiator of FIG. 4A according to various embodiments of the present disclosure.

FIG. 6 is a graph representing an efficiency related to a gain of each frequency of a first antenna radiator and a second antenna radiator according to a ground switching of the first antenna radiator of FIG. 4A according to various embodiments of the present disclosure.

According to various embodiments, the second antenna radiator 420, operates in a higher frequency band than the first antenna radiator 410, has a relatively short electric length of the radiation pattern, which may cause the second antenna radiator 320 to sensitively receive the influence of a human body upon being gripped, thereby degrading the radiating performance antenna. However, in an embodiment of the present disclosure, the second antenna radiator 320 is disposed at a position where it is coupled with the first antenna radiator 410, which may cause the second antenna radiator 320 to insensitively operate with respect to the influence of a human body, thereby preventing the degradation of the radiating performance in advance.

Further, when the electric length of the first antenna radiator is changed through the switching operation of a switch, the resonance length of the first antenna radiator may be changed. A change of the electric length of the first antenna radiator also makes the resonance length of the second antenna radiator varied so that the electric length of the first antenna radiator may be utilized as a tuning point.

Referring to FIG. 6, it can be seen that the operating frequency band of the second antenna radiator is changed according to the switching operation of the switch that is configured in the first antenna radiator. For example, it can be seen that an antenna gain of about 5 dB (30%) can be secured in LTE B7 (2055 MHz to 2690 MHz).

Figure 7:
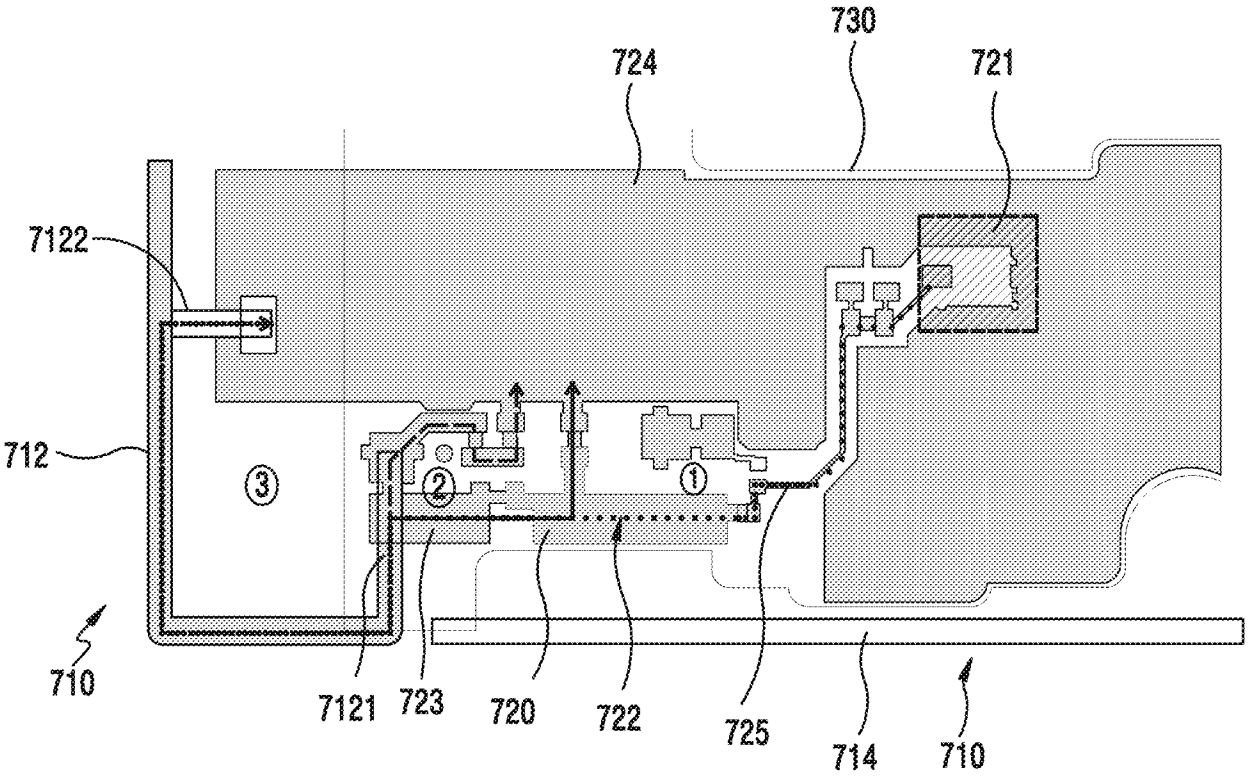
FIG. 7 is a diagram illustrating a configuration of an antenna device according to various embodiments of the present disclosure.

FIG. 7 is a diagram illustrating a configuration of an antenna device according to various embodiments of the present disclosure.

Referring to FIG. 7, a composite antenna device according to an embodiment of the present disclosure may include a first antenna radiator 710 and a second antenna radiator 720 coupled with the first antenna radiator 710 to operate.

According to various embodiments, since the configuration of the first antenna radiator 710 is the same as that illustrated in FIG. 3 or FIG. 4A, descriptions of the configuration of the first antenna radiator 710 will be omitted for the convenience of description. Here, reference numeral 714 denotes a lower bezel section.

According to various embodiments, the second antenna radiator 720 may be disposed within the electronic device. According to an embodiment, the second antenna radiator 720 may be disposed to face the lower bezel section 714 that is used as the first antenna radiator 710, and may be disposed at a position where it can be coupled to the lower bezel section 714.

According to an embodiment, the second antenna radiator 720 may be formed on a board 730 (a main board and/or a sub board) in a pattern manner. Without being limited thereto, however, the second antenna radiator 720 may be disposed in a region other than the board 730. According to an embodiment, the second antenna radiator 720 may be a metal plate that has a flexible printed circuit or pattern that includes a pattern that is disposed in a region other than the board 730 and operates in a specific frequency band. According to an embodiment, the second antenna radiator 720 may be attached to the inner face of the housing of the electronic device. According to an embodiment, in the case where the second antenna radiator 720 is a metal plate, the second antenna radiator 720 may be insert molded in the outer face, the inner face, or the inside of the housing that is formed of a synthetic resin material. According to an embodiment, the second antenna radiator 720 may be a conductive paint that is coated on the inner face or the outer face of the housing of the electronic device. According to an embodiment, the second antenna radiator 720 may be disposed on an antenna carrier made of a synthetic resin material.

According to an embodiment, the second antenna radiator 720 may be fed with power from the power feeding unit 721 of the board 730. According to an embodiment, the second antenna radiator 720 may include a radiating unit 722 or 723. According to an embodiment, the radiating unit 722 or 723 may be disposed at a position where it can be coupled with the lower bezel section 714. According to an embodiment, the radiating unit 722 or 723 may be electrically connected to the power feeding unit 721 by a predetermined wiring line 725. According to an embodiment, in such a case, at least one matching element may be interposed in the wiring line 725 between the second power feeding unit 721 and the radiating unit 722 in order to tune the operating frequency band of the second antenna radiator 720.

According to an embodiment, the second antenna radiator 720 is drawn out from the first region 722 of the radiating unit and is grounded to the ground portion 724 of the board through a wiring line so that the second antenna radiator 720 may include a first loop type radiation region (region ① of FIG. 7).

According to an embodiment, the second antenna radiator 720 is drawn out from the second region 723 of the radiating unit and is grounded to the ground portion 724 of the board through a wiring line so that the second antenna radiator 720 may include a second loop type radiation region (region ② of FIG. 7).

According to an embodiment, the second antenna radiator 720 is electrically connected with a first connection piece 7121 of the left bezel section 712 through the first region 722 and the second region 723 of the radiating unit, and a second connection piece 7122, which is spaced apart from the first connection piece 7121, is electrically connected to the ground portion 724 again such that the second antenna radiator may include a third loop type radiation region (region a of FIG. 7).

According to various embodiments, the second antenna radiator 720, which is disposed to be capable of being coupled with the first antenna radiator 710, may be implemented as a multi-band antenna radiator that is operable in a single band or at least two different bands. In addition, it is possible to change the operation frequency band by changing the electric length of the first antenna radiator 710.

According to various embodiments, it is possible to provide an antenna device that is implemented to maximize the antenna performance by securing a mounting space of the antenna device and a degree of freedom of a pattern of the antenna device, and an electronic device including the antenna device.

According to various embodiments, it is possible to provide an antenna device and an electronic device including the antenna device, in which at least two antennas are configured to operate in a mutually complementary manner while excluding a mutual interference therebetween such that the antenna device is implemented to secure an antenna performance and an efficient mounting space and to contribute to the slimming of an electronic device.

According to various embodiments, it is possible to provide an antenna device and an electronic device, in which the antenna device is implemented such that, even if a metallic member used for the exterior of the electronic device is used as an antenna, the performance of an internal antenna adjacent to the metal member is prevented from being degraded, and an influence by an external human body is reduced.

Figure 8:
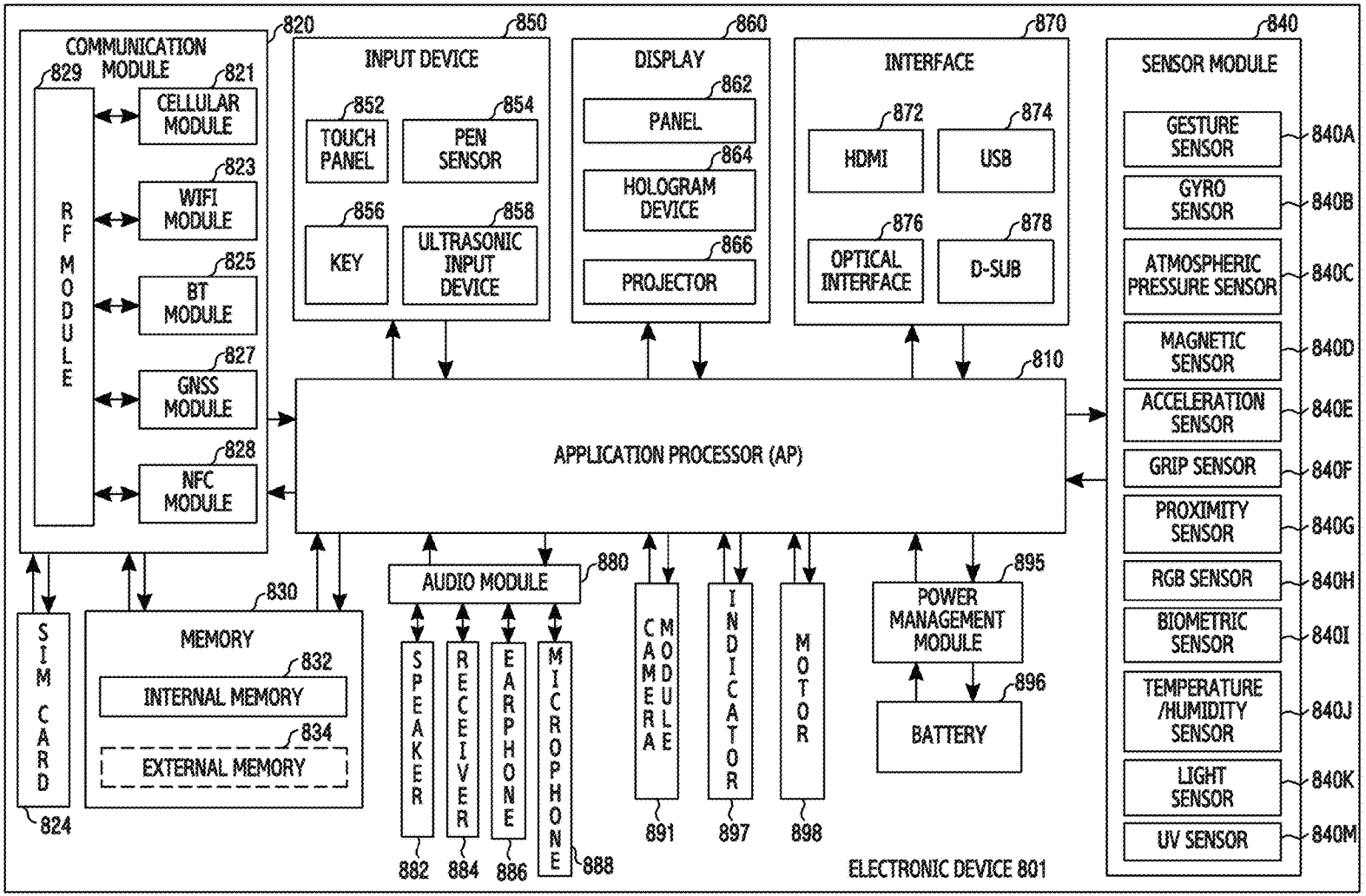
FIG. 8 is a block diagram of an electronic device according to various embodiments of the present disclosure.

FIG. 8 is a block diagram illustrating an electronic device according to various embodiments of the present disclosure.

Referring to FIG. 8, the electronic device 801 may, for example, correspond to the entire electronic device 101 shown in FIG. 1 or a part thereof. Referring to FIG. 8, the electronic device 801 may include at least one application processor (AP) 810, a communication module 820, a subscriber identifier module (SIM) card 824, a memory 830, a sensor module 840, an input device 850, a display 860, an interface 870, an audio module 880, a camera module 891, a power management module 895, a battery 896, an indicator 897, and a motor 898.

The AP 810 may control a plurality of hardware or software elements connected to the AP 810 by driving an operating system or an application program and process various types of data including multimedia data and perform calculations. The AP 810 may be implemented as, for example, a system on chip (SoC). According to an embodiment, the AP 810 may further include a graphic processing unit (GPU).

The communication module 820 (for example, the communication interface 160) may perform data transmission/reception in communication between the electronic device 801 (for example, the electronic device 101) and other electronic devices (for example, the electronic device 104 and the server 106) connected thereto through a network. According to an embodiment, the communication module 820 may include a cellular module 821, a Wi-Fi module 823, a BT module 825, a GPS module 827, an NFC module 828, and a Radio Frequency (RF) module 829.

The cellular module 821 may provide a voice call, a video call, a text message service, or an Internet service through a communication network (e.g., LTE, LTE-A, CDMA, WCDMA, UMTS, WiBro, or GSM). Furthermore, the cellular module 821 may distinguish and authenticate electronic devices within a communication network, for example, using a subscriber identification module (e.g., the SIM card 824). According to an embodiment, the cellular module 821 may perform at least some functions which the AP 810 may provide. For example, the cellular module 821 may perform at least some of the multimedia control functions.

According to an embodiment, the cellular module 821 may include a communication processor (CP). In addition, the cellular module 821 may be implemented by, for example, a SoC. Although the elements such as the cellular module 821 (e.g., communication processor), the memory 830, and the power management module 895 are illustrated as separate elements from the AP 810 in FIG. 8, according to an embodiment, the AP 810 may be implemented so as to include at least some of the above elements (e.g., the cellular module 821).

According to an embodiment, the AP 810 or the cellular module 821 (for example, the communication processor) may load a command or data received from at least one of a non-volatile memory and other components connected thereto in a volatile memory, and may process the loaded command or data. Also, the AP 810 or the cellular module 821 may store, in a non-volatile memory, data received from or generated by at least one of other elements.

The Wi-Fi module 823, the BT module 825, the GPS module 827, and the NFC module 828 may include, for example, a processor for processing data transmitted/received through a corresponding module. Although the cellular module 821, the WiFi module 823, the BT module 825, the GPS module 827, and the NFC module 828 are illustrated as separate blocks in FIG. 8, at least some (for example, two or more) of the cellular module 821, the Wi-Fi module 823, the BT module 825, the GPS module 827, and the NFC module 828 may be included in one Integrated Chip (IC) or one IC package in an embodiment. For example, at least some (for example, the communication processor corresponding to the cellular module 821 and the Wi-Fi processor corresponding to the Wi-Fi module 823) of the processors corresponding to the cellular module 821, the Wi-Fi module 823, the BT module 825, the GPS module 827, and the NFC module 828 may be implemented as one SoC.

The RF module 829 may transmit/receive data, for example, an RF signal. Although not illustrated in the drawing, the RF module 829 may, for example, include a transceiver, a power amp module (PAM), a frequency filter, a low noise amplifier (LNA), or the like. Further, the RF module 829 may further include a component for transmitting/receiving electronic waves over a free air space in wireless communication, for example, a conductor, a conducting wire or the like. Although the cellular module 821, the Wi-Fi module 823, the BT module 825, the GPS module 827, and the NFC module 828 share one RF module 829 in FIG. 8, at least one of the cellular module 821, the Wi-Fi module 823, the BT module 825, the GPS module 827, and the NFC module 828 may transmit/receive an RF signal through a separate RF module in an embodiment.

The SIM card 824 may be a card including a subscriber identification module, and may be inserted into a slot formed in a particular portion of the electronic device. The SIM card 824 may include unique identification information (for example, an integrated circuit card identifier (ICCID)) or subscriber information (for example, an international mobile subscriber identity (IMSI))

The memory 830 (for example, the memory 130) may include an internal memory 832 or an external memory 834. The internal memory 832 may include, for example, at least one of a volatile memory (e.g., a dynamic RAM (DRAM), a static RAM (SRAM), and a synchronous dynamic RAM (SDRAM)), and a non-volatile memory (e.g., a one time programmable ROM (OTPROM), a programmable ROM (PROM), an erasable and programmable ROM (EPROM), an electrically erasable and programmable ROM (EEPROM), a mask ROM, a flash ROM, a NAND flash memory, and an NOR flash memory).

According to an embodiment, the internal memory 832 may be a solid state drive (SSD). The external memory 834 may further include a flash drive, for example, a compact flash (CF), a secure digital (SD), a micro secure digital (Micro-SD), a mini secure digital (Mini-SD), an extreme digital (xD), a Memory Stick, or the like. The external memory 834 may be functionally connected to the electronic device 801 through various interfaces. According to an embodiment, the electronic device 801 may further include a storage device (or storage medium) such as a hard drive.

The sensor module 840 may measure a physical quantity or detect an operation state of the electronic device 801, and may convert the measured or detected information to an electrical signal. The sensor module 840 may include at least one of, for example, a gesture sensor 840A, a gyro sensor 840B, an atmospheric pressure sensor 840C, a magnetic sensor 840D, an acceleration sensor 840E, a grip sensor 840F, a proximity sensor 840G, a color sensor 840H (e.g., a Red/Green/Blue (RGB) sensor), a bio-sensor 840I, a temperature/humidity sensor 840J, an illumination sensor 840K, and an Ultraviolet (UV) sensor 840M. Additionally or alternatively, the sensor module 840 may include, for example, an E-nose sensor (not illustrated), an electromyography (EMG) sensor (not illustrated), an electroencephalogram (EEG) sensor (not illustrated), an electrocardiogram (ECG) sensor (not illustrated), an Infrared (IR) sensor, an iris sensor (not illustrated), a fingerprint sensor, and the like. The sensor module 840 may further include a control circuit for controlling one or more sensors included in the sensor module 840.

The input device 850 may include a touch panel 852, a (digital) pen sensor 854, a key 856, or an ultrasonic input device 858. The touch panel 852 may recognize a touch input in at least one of, for example, a capacitive scheme, a resistive scheme, an infrared scheme, and an acoustic wave scheme. Further, the touch panel 852 may further include a control circuit. A capacitive touch panel may recognize a physical contact or proximity. The touch panel 852 may further include a tactile layer. In this event, the touch panel 852 may provide a tactile response to the user.

The (digital) pen sensor 854 may be embodied, for example, using a method identical or similar to a method of receiving a touch input from a user, or using a separate recognition sheet. The key 856 may include, for example, a physical button, an optical key, or a keypad. The ultrasonic input device 858 may identify data by detecting an acoustic wave with a microphone (for example, the microphone 888) of the electronic device 801, through an input unit generating an ultrasonic signal, and may perform wireless recognition. According to an embodiment, the electronic device 801 may receive a user input from an external device (for example, computer or server) connected thereto using the communication module 820.

The display 860 (for example, the display 160) may include a panel 862, a hologram device 864, or a projector 866. The panel 862 may be, for example, a Liquid Crystal Display (LCD) and an Active Matrix Organic Light Emitting Diode (AM-OLED) display, and the like. The panel 862 may be implemented to be, for example, flexible, transparent, or wearable. The panel 862 may include the touch panel 852 and one module. The hologram device 864 may show a stereoscopic image in the air by using interference of light. The projector 866 may project light onto a screen to display an image. The screen may be located, for example, inside or outside the electronic device 801. According to an embodiment, the display 860 may further include a control circuit for controlling the panel 862, the hologram device 864, or the projector 866.

The interface 870 may include, for example, a HDMI 872, a USB 874, an optical interface 876, or a d-subminiature (D-sub) 878. The interface 870 may be included in, for example, the communication interface 160 illustrated in FIG. 1. Additionally or alternatively, the interface 870 may include, for example, a mobile high-definition link (MHL) interface, a secure digital (SD) card/multi-media card (MMC) interface, or an infrared data association (IrDA) standard interface.

The audio module 880 may bilaterally convert a sound and an electrical signal. At least some components of the audio module 880 may be included in, for example, the input/output interface 140 illustrated in FIG. 1. The audio module 880 may process sound information input or output through, for example, the speaker 882, the receiver 884, the earphones 886, the microphone 888 or the like.

The camera module 891 is a device for capturing a still image or a video, and according to an embodiment, may include one or more image sensors (e.g., a front sensor or a rear sensor), a lens (not illustrated), an image signal processor (ISP) (not illustrated), or a flash (not illustrated) (e.g., an LED or xenon lamp).

The power management module 895 may manage the power usage of the electronic device 801. Although not illustrated, the power management module 895 may include, for example, a power management integrated circuit (PMIC), a charger integrated circuit (IC), or a battery or fuel gauge.

The PMIC may be mounted to, for example, an integrated circuit or a SoC semiconductor. Charging methods may be classified into a wired charging method and a wireless charging method. The charger IC may charge a battery and may prevent an overvoltage or excess current from being induced or flowing from a charger. According to an embodiment of the present disclosure, the charger IC may include a charger IC for at least one of the wired charging method and the wireless charging method. A magnetic resonance scheme, a magnetic induction scheme, or an electromagnetic scheme may be exemplified as the wireless charging method, and an additional circuit for wireless charging, such as a coil loop circuit, a resonance circuit, a rectifier circuit, and the like may be added.

The battery gauge may measure, for example, a remaining quantity of the battery 896, or a voltage, a current, or a temperature during charging. The battery 896 may store or generate electricity, and may supply power to the electronic device 801 by using the stored or generated electricity. The battery 896 may include, for example, a rechargeable battery or a solar battery The indicator 897 may display a specific status of the electronic device 801 or a part (e.g. the AP 810) of electronic device, for example, a booting status, a message status, a charging status, and the like. The motor 898 can convert an electrical signal into a mechanical vibration. Although not illustrated, the electronic device 801 may include a processing unit (e.g., GPU) for supporting a mobile TV. The processing device for supporting mobile TV may process media data according to a standard of digital multimedia broadcasting (DMB), digital video broadcasting (DVB), media flow or the like.

Each of the above-described elements of the electronic device according to various embodiments of the present disclosure may include one or more components, and the name of a corresponding element may vary according to the type of electronic device. The electronic device according to various embodiments of the present disclosure may include at least one of the above-described elements, and may exclude some of the elements or further include other additional elements. Further, some of the components of the electronic device according to the various embodiments of the present disclosure may be combined to form a single entity, and thus, may equivalently execute functions of the corresponding elements prior to the combination.

The "module" used in various embodiments of the present disclosure may refer to, for example, a "unit" including one of hardware, software, and firmware, or a combination of two or more of the hardware, software, and firmware. The "module" may be interchangeable with a term, such as a unit, a logic, a logical block, a component, or a circuit. The "module" may be a minimum unit of an integrated component element or a part thereof. The "module" may be the smallest unit that performs one or more functions or a part thereof. The "module" may be mechanically or electronically implemented. For example, the "module" according to various embodiments of the present disclosure may include at least one of an application-specific integrated circuit (ASIC) chip, a field-programmable gate arrays (FPGAs), and a programmable-logic device for performing operations which have been known or are to be developed hereafter.

According to various embodiments, at least some of the devices (e.g., modules or functions thereof) or methods (e.g., operations) according to the various embodiments of the present disclosure may be implemented as, for example, instructions stored in non-transitory computer readable storage media in the form of programming modules. When the command is executed by one or more processors (for example, the processor 810), the one or more processors may execute a function corresponding to the command. The non-transitory computer-readable storage medium may be, for example, the memory 220. At least a part of the programming module may be implemented (for example, executed) by, for example, the processor 810. At least some of the programming modules may include, for example, a module, a program, a routine, a set of instructions or a process for performing one or more functions.

The non-transitory computer readable recording medium may include magnetic media such as a hard disc, a floppy disc, and a magnetic tape, optical media such as a compact disc read-only memory (CD-ROM) and a DVD, magneto-optical media such as a floptical disk, and hardware devices specifically configured to store and execute program commands, such as a read-only memory (ROM), a random-access memory (RAM), and a flash memory. In addition, the program instructions may include high-class language codes, which can be executed by a computer by using an interpreter, as well as machine codes made by a compiler. The aforementioned hardware device may be configured to operate as one or more software modules in order to perform the operation of various embodiments of the present disclosure, and vice versa.

A module or a programming module according to various embodiments of the present disclosure may include at least one of the above-described elements, may exclude some of the elements, or may further include other additional elements. Operations executed by a module, a programming module, or other component elements according to various embodiments of the present disclosure may be executed sequentially, in parallel, repeatedly, or in a heuristic manner. Further, some operations may be executed according to another order or may be omitted, or other operations may be added.

FIGS. 1, 2A-2C, 3, 4A-4C, 5-8 are provided as an example only. At least some of the operations discussed with respect to these figures can be performed concurrently, performed in a different order, and/or altogether omitted. It will be understood that the provision of the examples described herein, as well as clauses phrased as "such as," "e.g.", "including", "in some aspects," "in some implementations," and the like should not be interpreted as limiting the claimed subject matter to the specific examples.

The above-described aspects of the present disclosure can be implemented in hardware, firmware or via the execution of software or computer code that can be stored in a recording medium such as a CD-ROM, a DVD, a magnetic tape, a RAM, a floppy disk, a hard disk, or a magneto-optical disk or computer code downloaded over a network originally stored on a remote recording medium or a non-transitory machine-readable medium and to be stored on a local recording medium, so that the methods described herein can be rendered via such software that is stored on the recording medium using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein. Any of the functions provided in the figures may be implemented in hardware, software or a combination of both and may be performed in whole or in part within the programmed instructions of a computer. No claim element herein is to be construed under the provisions of 35 U.S.C. 112, sixth paragraph, unless the element is expressly recited using the phrase "means for".

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a housing including:

a first face directed in a first direction, a second face directed in a second direction opposite to the first direction, and a side face at least partially enclosed a space between the first face and the second face;

a ground member disposed within the housing;

at least one communication circuit disposed within the housing;

a first conductive member that forms at least a portion of the side face and operating as a first antenna radiator, the first conductive member being electrically coupled to the communication circuit and the ground member;

a second conductive member that forms at least a portion of the side face, the second conductive member being disposed adjacent to the first conductive member and electrically insulated from the first conductive member;

a conductive pattern disposed within the housing, operating as a second antenna radiator and including a portion disposed adjacent to one end of the first conductive member, the conductive pattern being electrically coupled to the communication circuit and the ground member, and the conductive pattern being disposed at a position where it can be capacitively coupled to the first conductive member;

a first electric path disposed within the housing, and configured to electrically interconnect a vicinity of another end of the first conductive member and the communication circuit;

a second electric path configured to electrically interconnect the first electric path or the first conductive member and the ground member; and a third electric path configured to electrically interconnect the first electric path or the first conductive member and the ground member, and including a switching circuit, wherein the second conductive member is electrically coupled to the ground member at a first point of the second conductive member, and wherein the conductive pattern is electrically coupled to the second conductive member at a second point of the second conductive member different from the first point, thereby forming an additional loop type radiation region.

2. The electronic device of claim 1, wherein the conductive pattern is formed as a pattern on a board, disposed on an antenna carrier, or disposed on an external housing of the electronic device made of a synthetic resin material.

3. The electronic device of claim 1, wherein the conductive pattern is a flexible printed circuit board (FPCB) including a metal pattern, a metal plate having a predetermined pattern shape, or a conductive paint coated on a peripheral structure.

4. The electronic device of claim 1, wherein at least one matching element configured to adjust a resonance frequency of the conductive pattern is interposed between the communication circuit and the conductive pattern.

5. The electronic device of claim 1, wherein the conductive pattern adjusts at least one of a resonance frequency and a bandwidth by adjusting a distance between the conductive pattern and the first conductive member, a thickness of a radiation pattern of the conductive pattern, or a coupling region between the conductive pattern and the first conductive member.

6. The electronic device of claim 1, further comprising:

a fourth electric path configured to electrically interconnect the first conductive member and the ground member, and including another switching circuit.

7. The electronic device of claim 1, wherein an operating frequency band of the first conductive member is changed according to a switching operation of the switching circuit.

8. The electronic device of claim 7, wherein an operating frequency band of the first conductive member is changed according to the switching operation of the switching circuit.

9. The electronic device of claim 1, wherein the conductive pattern includes at least two loop type radiation regions configured to be fed with power through the communication circuit and to be grounded through the ground member.

10. The electronic device of claim 9, wherein the at least two loop type radiation regions of the conductive pattern are designed to operate in different frequency bands, respectively, to operate as multi-band antenna radiators.

11. The electronic device of claim 1, wherein the electric length of the conductive pattern is formed to be relatively shorter than the electric length of the first conductive member.

12. The electronic device of claim 1, wherein the first conductive member and the second conductive member are a first metal bezel and a second metal bezel respectively that are disposed to enclose at least a portion of the exterior of the electronic device.

13. An electronic device comprising:

a board including a communication circuit;

a first conductive member disposed in at least a partial region of the electronic device, and configured to be used as a first antenna radiator by being fed with power through the communication circuit;

a second conductive member that forms at least a portion of the side face, the second conductive member being disposed adjacent to the first conductive member and electrically insulated from the first conductive member;

a switch branched from a power feeding line of the first conductive member to selectively electrically interconnect a ground member of the board and the first conductive member; and a conductive pattern formed on the board that is configured to be used as a second antenna radiator and is fed with power through the communication circuit, the conductive pattern being disposed to cause a radiation region to be capacitively coupled with at least a partial region of the first conductive member, wherein frequency bands of the first conductive member and the conductive pattern are changed according to a switching operation of the switch, wherein the second conductive member is electrically coupled to the ground member at a first point of the second conductive member, and wherein the conductive pattern is electrically connected to the second conductive member at a second point of the second conductive member different from the first point, thereby forming an additional loop type radiation region.

14. The electronic device of claim 13, wherein the first conductive member and the second conductive are a first metal bezel and a second metal bezel respectively that are disposed to enclose at least a portion of the exterior of the electronic device.

* * * * *